US005320785A

United States Patent [19]

Dermeik

[11] Patent Number: 5,320,785

[45] Date of Patent: Jun. 14, 1994

[54] COMPOSITIONS CONTAINING PHOSPHONO COMPOUNDS AND ORGANIC ACIDS AS FLAMEPROOFING AGENTS

[75] Inventor: Salman Dermeik, Augsburg, Fed. Rep. of Germany

[73] Assignee: Ciba-Geigy Corporation, Ardsley, N.Y.

[21] Appl. No.: 736,679

[22] Filed: Jul. 26, 1991

[30] Foreign Application Priority Data

Aug. 3, 1990 [DE] Fed. Rep. of Germany ..... 4024663

[51] Int. Cl.[5] ..... C09K 21/10; D06M 13/00

[52] U.S. Cl. ..... 252/608; 252/601; 106/18.14; 8/115.51; 8/181

[58] Field of Search ..... 252/608; 8/115.51; 106/18.14

[56] References Cited

U.S. PATENT DOCUMENTS

| | | | |
|---|---|---|---|
| 3,374,292 | 6/1969 | Abdul | 260/943 |
| 3,627,767 | 12/1971 | Nachbur et al. | 260/256.5 R |
| 3,639,539 | 2/1972 | Nachbur et al. | 260/942 |
| 3,671,611 | 6/1972 | Nachbur et al. | 260/932 |
| 3,824,232 | 7/1974 | Pusch et al. | 260/249.6 |
| 3,878,245 | 4/1975 | Nachbur et al. | 260/553 R |
| 3,892,906 | 7/1975 | Swidler et al. | 428/289 |
| 3,931,310 | 1/1976 | Nachbur et al. | 260/551 |
| 3,933,426 | 1/1976 | Martini et al. | 8/183 |
| 3,954,866 | 5/1976 | Frank et al. | 260/568 |
| 3,958,061 | 5/1976 | Singer et al. | 428/276 |
| 3,994,971 | 11/1976 | Nachbur et al. | 260/551 C |
| 4,013,813 | 3/1977 | Le Blanc et al. | 428/272 |
| 4,015,037 | 3/1977 | Smith et al. | 428/245 |
| 4,072,776 | 2/1978 | Linke et al. | 427/390 D |
| 4,104,172 | 9/1978 | Smith et al. | 252/8.1 |
| 4,136,037 | 1/1979 | Le Blanc et al. | 252/8.1 |
| 4,162,279 | 7/1979 | Walsh et al. | 260/943 |
| 4,177,300 | 12/1979 | Walsh et al. | 427/390 D |
| 4,178,398 | 12/1979 | Nachbur et al. | 427/379 |
| 4,246,031 | 1/1981 | Elgae et al. | 106/18.14 |
| 4,265,945 | 5/1981 | Frank | 427/353 |
| 4,292,036 | 9/1981 | Walsh et al. | 8/182 |

FOREIGN PATENT DOCUMENTS

| | | |
|---|---|---|
| 0735917 | 7/1969 | Belgium . |
| 881344 | 7/1980 | Belgium . |
| 0881344 | 7/1980 | Belgium . |
| 0057668 | 1/1982 | European Pat. Off. . |
| 0076138 | 4/1983 | European Pat. Off. . |
| 1469281 | 5/1969 | Fed. Rep. of Germany . |
| 2147481 | 8/1973 | Fed. Rep. of Germany . |
| 2458845 | 6/1976 | Fed. Rep. of Germany . |
| 2737850 | 3/1978 | Fed. Rep. of Germany . |
| 2055485 | 4/1971 | France . |
| 0111399 | 9/1975 | Japan . |
| 0163483 | 9/1984 | Japan . |
| 0021973 | 2/1985 | Japan . |
| 0198685 | 8/1989 | Japan . |
| 0671491 | 5/1981 | Switzerland . |
| 671491 | 9/1989 | Switzerland . |
| 1139380 | 1/1969 | United Kingdom . |

OTHER PUBLICATIONS

"Reactions of Acid Chlorides", *Organic Chemistry*, Ralph S. & Joan Fessenden, University of Montana, 2nd ed. 1982.

*Primary Examiner*—Robert L. Stoll
*Assistant Examiner*—Joseph D. Anthony
*Attorney, Agent, or Firm*—Kevin T. Mansfield; Edward McC. Roberts

[57] ABSTRACT

The permanence of the flame-resistant finish of fibre materials, in particular those based on cellulose, is improved if a phosphono compound which contains an N-methylol group. is used together with an organic carboxylic acid as the finishing agent. If oxalic acid in particular is used as the carboxylic acid, the finished fibre material can be stored in a damp environment for a prolonged period of time without intermediate washing being necessary. The tendency of the finish to hydrolyse in a damp atmosphere is reduced by using the organic carboxylic acid instead of a mineral acid.

8 Claims, No Drawings

COMPOSITIONS CONTAINING PHOSPHONO COMPOUNDS AND ORGANIC ACIDS AS FLAMEPROOFING AGENTS

The present invention relates to an aqueous composition containing at least the following components:

a) a phosphono compound of the formula

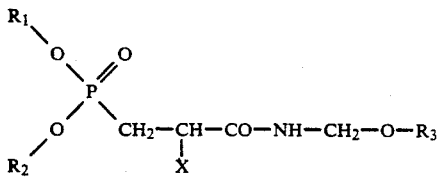

(I)

wherein $R_1$ and $R_2$ independently of one another represent an alkyl radical having 1 to 4 carbon atoms or a phenyl radical, which can optionally contain one or more halogen atoms as substituents, or wherein $R_1$ and $R_2$ together represent an alkylene bridge having a maximum of 4 carbon atoms, which can optionally be substituted by one or more halogen atoms, X represents H or $CH_3$ and wherein, $R_3$represents hydrogen, an allyl radical or an alkyl radical having 1 to 6 carbon atoms, b) an acid.

It furthermore relates to a process for providing fibre material with a flame-resistant finish using such compositions.

Compositions of the abovementioned type are known from GB-PS 1 139 380.

A method which has been known for a long time for providing fibre materials, in particular textile fibre materials which consist of cellulose fibres or contain cellulose fibres, with a flame-resistant finish comprises applying certain phosphono compounds to the materials. This is described, for example, in DE-OS 1469281. It has been found that the permanence of the flame-resistant finish, i.e. the persistent effectiveness of the flameproofing after washing processes, can be improved on cellulosic materials in particular if phosphono compounds in combination with acids are applied to the cellulose materials, and the materials are then dried and subsequently subjected to heat treatment at above 100° C. This is described in GB-PS 1 139 380. According to the teaching of this specification, the phosphono compounds are employed for this purpose together with strong mineral acids, such as phosphoric acid, sulphuric acid or hydrochloric acid, or together with compounds which form such acids, if appropriate at elevated temperature or on the basis of a reaction with water. Examples of these are $NH_4Cl$, $PC_3$, $PC_5$, $POCl_3$ and $SO_2Cl_2$. It can be assumed that in compounds containing N-methylol groups (which are preferably used), the acid catalyses the etherification of these N-methylol groups with the OH groups of the cellulose, and that the permanence of the flame-resistant finish is effected by chemical bonding of the phosphono compound to the cellulose. It has now been found, however, that although the procedure according to GB-PS 1 139 380 provides a number of advantages compared with other possibilities for providing cellulose with a flame-resistant finish, some disadvantages also result.

On the one hand, it has been found that the effectiveness (flame-retardant action) of the finish decreases somewhat if the textile material is subjected to domestic washes and is not washed for a prolonged period of time between these washes. However, the effectiveness also decreases if the textile material is stored in a damp environment for a prolonged period of time. At the same time, a decrease in the "fabric pH value" is found on prolonged storage. "Fabric pH value" is to be understood as the pH of an aqueous solution obtained when the fabric is extracted with water (the method is described below). The decrease in the effectiveness of the flame-resistant finish can be monitored by determination of the burning properties in accordance with DIN 54 336. It has furthermore been found that the decrease in the effectiveness of the flame-resistant finish on cellulose materials finished in accordance with GB-PS 1 139 380 is accompanied by a decrease in the phosphorus content on the goods. If nitrogen compounds, such as, for example, melamine derivatives, have additionally been employed together with phosphono compounds, a decrease in the N content on the goods is also found after prolonged storage in a damp environment or after domestic washes. The findings described could be explained by the fact that the strong mineral acid catalyses not only-as described above-the etherification of N-methylol groups with cellulosic OH groups, but also the resplitting of the ether (hydrolysis), whereupon products which are washed out during domestic washes are formed. Although an after-wash (for example with sodium carbonate solution) is carried out after the condensation (etherification under heat treatment) in the process according to GB-PS 1 139 380 in order to remove free acid, acid is reformed during storage of the goods in a damp environment or during domestic washes. The acid formed again in this way catalyses the hydrolysis of the ether of the N-methylolphosphono compound and cellulose, which means that the finishing products can be washed out again. The consequence is a decrease in the effectiveness of the flame-resistant finish. For the reasons described, it is appropriate or even necessary in the case of goods finished in accordance with GB-PS 1 139 380 for the goods to be washed at certain intervals of time during storage in order to remove the acid which has formed again in the meantime. The use of phosphoric acid together with an N-methylolphosphono compound, as is recommended, inter alia, according to GB-PS 1 139 380, also means that the optimum temperature (condensation temperature) for after-treatment of the finished goods is about 150° C. It has now been found that although a higher condensation temperature, for example 170 ° to 180° C., leads to even better fixing of the flame-resistant finish (N-methylolphosphono compound) to the fabric, if phosphoric acid is used here the risk of damage to the (cellulosic) fabric results (deterioration of the textile data).

The object of the present invention was to provide aqueous compositions which render effective flame-resistant finishing of fibre materials, in particular materials containing cellulose fibres, possible. These compositions should have the effect of an improved permanence of the flame-resistant finish after storage in a damp environment compared with the finishing effects achieved with known compositions. At the same time, the compositions should render it possible for the fibre materials finished with them, even after prolonged storage, to have to be subjected to an intermediate wash, if at all, only at longer intervals of time than is the case with the known finishing products.

The object was achieved an aqueous composition containing at least the following components:

a) a phosphono compound of the formula

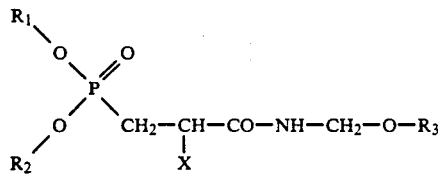

(I)

wherein $R_1$ and $R_2$ independently of one another are an alkyl radical having 1 to 4 carbon atoms or a phenyl radical, which can optionally contain one or more halogen atoms as substituents, or wherein $R_1$ and $R_2$ together are an alkylene bridge having a maximum of 4 carbon atoms, which can optionally be substituted by one or more halogen atoms, X is hydrogen or methyl and $R_3$, is hydrogen, an allyl radical of 1 to 6 carbon atoms, or an alkyl radical of 1 to 6 carbon atoms, a b) an acid, selected from an aliphatic or cycloaliphatic, saturated or olefinically unsaturated monobasic or polybasic carboxylic acid and a mixture thereof. Preferred embodiments of the compositions according to the invention can be seen from the subclaims.

The compositions according to the invention have, inter alia, the following advantages:

1. Fixing of the phosphono compound, which acts as the flameproofing, to the fibre material can be carried out at higher temperatures, for example up to 180° C., (and is hence more effective) than in the process according to GB-PS 1 139 380 using, for example, phosphoric acid. If phosphoric acid is used, temperatures of 170 ° to 180° C. may lead to damage of the fibre material (textile data and yellowing of fabric).

2. The permanence of the flame-resistant finish is better when compositions according to the invention are used than if compositions according to GB-PS 1 139 380 are used. This better permanence manifests itself in improved burning properties of the finished fibre materials and in a lower decrease in the phosphorus content and pH of the fibre material both after washing processes and after storage in a damp environment If a composition according to the invention is used - as preferred - which additionally contains as component c) a water-soluble substituted melamine, some or all of the amino groups of which are methylolated, it being possible for some or all of these N-methylol groups to be etherified with an aliphatic alcohol, in particular methanol, the nitrogen content on the fibre material also decreases less after washing or storage than if acids according to GB-PS 1 139 380 are used. These findings are probably associated with the fact that in the case of compositions according to the invention, the hydrolysis after storage in a damp environment is less pronounced (hydrolysis of the bonds between the phosphono compound and cellulose).

3. The amount of phosphorus compounds and nitrogen compounds which pass into the effluent after washing of the goods is lower than in the case of the finish according to GB-PS 1 139 380, and in particular for the following reason: the fixing of the phosphono compound and the nitrogen compound (for example in the form of the melamine derivatives additionally used) to the fibre material is better, and the tendency to undergo hydrolysis is weakened. The difference in the phosphorus content of the effluent is of course even greater if phosphoric acid or another phosphorus compound, such as a phosphorus (oxy)halide, is employed in the process of the GB-PS.

4. Washing with an alkaline solution or dispersion is indeed also indicated in the case of compositions according to the invention after fixing of the phosphono compound to the fibre material (treatment at elevated temperature, for example up to 180° C.), in order to remove the free acid. However, a major advantage is that, in contrast to known finishing processes, after storage of the finished goods regular washing can either be omitted completely, or has to take place only at considerably longer intervals of time. The reason for this is probably that less free acid is subsequently formed during storage. This is substantiated by the finding that a higher (less acid) "fabric pH value" is found after washing and storage on cellulose material which is finished with compositions according to the invention than on goods finished with known compositions. In the case of goods finished by means of processes according to the prior art, the amounts of free acid subsequently formed have to be washed out more often, so that they do not catalyse hydrolysis of the ether of the phosphono compound and cellulose.

5. If nitrogen compounds, such as melamine derivatives, are also used alongside phosphono compounds, fixing thereof to the fibre material is also more permanent (detectable by a smaller decrease in the nitrogen content on the fibre material after storage or washing) than in the case of compositions known from the prior art, for example from GB-PS 1 139 380. The better fixing or permanence of the melamine derivatives on the one hand results in a further increase in the effectiveness of the flame-resistant finish, and on the other hand the creaseproof properties of the cellulose articles become more permanent due to better fixing of the melamine derivatives.

In addition to water, the aqueous compositions according to the invention contain at least a) a phosphono compound of the formula

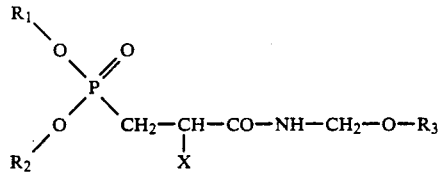

(I)

and b) an acid.

In formula (I) $R_1$ and $R_2$ in each case independently of one another represent either an alkyl radical having 1 to 4 carbon atoms or a phenyl radical, or together they form an alkylene bridge having not more than 4 carbon atoms. The alkyl radical, the phenyl radical or the alkylene bridge can in each case contain one or more halogen atoms as substituents; chlorine or bromine atoms are preferred substituents here. The substituent X represents hydrogen or a methyl group. The radical $R_3$ represents hydrogen, an allyl radical or an alkyl radical having 1 to 6 carbon atoms. This alkyl radical can be linear or branched. The alkyl radical or the allyl radical can contain one or more halogen atoms as substituents, and chlorine or bromine are again preferred as substituents.

Particularly favourable results are obtained if the compositions according to the invention contain a phosphono compound of the formula

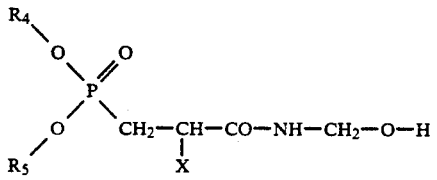

In this formula, the radicals $R_4$ and $R_5$ independently of one another each represent a methyl or ethyl group, for example both, $R_4$ and $R_5$ represent a methyl group.

Suitable phosphono compounds of the formulae(I) and (II) and their preparation are described in GB-PS 1 139 380 and in DE-OS 14 69 281.

In addition to the phosphono compound mentioned, the compositions according to the invention also contain an aliphatic or cycloaliphatic mono- or polybasic carboxylic acid. They can also contain a mixture of acids of the types mentioned. Carboxylic acids having 2 to 6 C atoms and containing two or more, in particular two or three, —COOH groups are preferred for this. In addition to carboxyl groups, the acids can contain other functional groups, in particular hydroxyl groups. Examples of suitable acids are, inter alia, glycolic acid, maleic acid, malonic acid, tartaric acid, succinic acid and malic acid. Particularly good results have been obtained with oxalic acid.

It is advantageous if the compositions according to the invention also contain one or more of the components c) to e) described below in addition to the components a) (phosphono compound) and b) (carboxylic acid) mentioned.

Component c):

This is a water-soluble substituted melamine, some or all of the amino groups of which are methylolated, or a mixture of such melamines. In the normal case, this is not a chemically uniform product, since a mixture of N-methylolated melamines with a varying number of nitrogen-bonded methylol groups per molecule are obtained during the methylolation (with formaldehyde). The average number of N-bonded methylol groups per molecule can be, for example, 4 or 5 in substituted melamines which are particularly suitable for the compositions according to the invention. All or some of the N-methylol groups present here can be in a form etherified with an aliphatic alcohol, in particular in a form etherified with methanol. The preparation of suitable substituted melamines is described in DE-PS 20 05 166. The advantage of an addition of component c) (substituted melamine) is that this addition contributes towards improving the crease properties of finished cellulosic materials and further increases the effectiveness of the flame-resistant finish. Although component c) is employed in the compositions according to the invention in the form of a water-soluble product, products which can no longer be washed out with water are formed during heat treatment of the finished fibre materials, for example at 150° C. to 180° C.

Component d):

Component d) is a product which is formed by reaction of dicyandiamide (DCDA) with formaldehyde and subsequent, at least partial, etherification, in particular etherification with methanol. The advantage of adding component d) is that on the one hand it increases the effectiveness of the flame-resistant finish, and on the other hand, because of the basic groups it contains, it can serve as a buffer against the liberation of acid in stored goods. A particularly advantageous and suitable component d) is a product which is formed by reaction of dicyandiamide (DCDA) with formaldehyde in a molar ratio of 1:1 to 1:2.5 at a pH of 5.0 to 10.0 and at a temperature of less than 80° C. and in which at least 30% of the N-methylol groups are etherified with a saturated aliphatic alcohol having 1 to 4 C atoms. Such products are preferably used in the form of aqueous solutions having a pH of 4.5 to 8.5 (at 20° C.) as component d) for the compositions according to the invention. In addition to the reaction products mentioned, these aqueous solutions preferably also contain an acid, which can be partially or completely neutralised if appropriate. Amidosulphonic acid and salts thereof are particularly suitable for this purpose. These aqueous solutions containing component d) can be prepared by reacting dicyandiamide DCDA with formaldehyde in a molar ratio of 1:1 to 1:2.5 at a temperature of less than 80° C. and a pH of 5.0 to 10.0 in a saturated aliphatic alcohol having 1 to 4 C atoms as the solvent, adding an acid to the solution when the reaction has ended, heating the solution until at least 30% of all the $N—CH_2—O$ groups, preferably 50 to 80%, are etherified, partially or completely neutralising the acid, removing at least 75% of the alcohol from the solution, adding water to the residue, if appropriate adjusting the pH to a value of 4.5 to 8.5 and if appropriate adding a formaldehyde-trapping agent, for example urea or a substituted urea, or a polyhydric alcohol or a polyglycol. It is advantageous if 0.05/n to 0.3/n, in particular 0.1/n to 0.2/n tool of acid per tool of DCDA employed added in this preparation process, n being the valency of the acid, and/or if the acid is partially or completely neutralised by addition of ammonium carbonate, the pH of the aqueous solution is adjusted by addition of ammonium hydrogen phosphate, 0.05 to 0.3, in particular 0.1 to 0.2 tool of diammonium hydrogen phosphate per tool DCDA originally employed is added to the solution, at the same time as the addition of water or, thereafter, boric anhydride, boric acid and/or a salt of boric acid is added, preferably in an amount such that the aqueous solution contains 1.5 to 11% by weight of boron compound, calculated as $B_2O_3$ and based on the total amount of all the constituents dissolved in the water, the alcohol used as the solvent is methanol, at least 75% of the solvent is removed by distillation under reduced pressure at a temperature of not more than 50° C., and/or if DCDA is reacted with formaldehyde in a molar ratio of 1:1.15 to 1:1.8.

Products which are suitable as component d) and their preparation are described in the DE patent application with Application No. P 40 24 473.3 of Aug. 2, 1990.

One possibility of preparing a product which is suitable as component d) comprises the following process:

168 g (2 tool) of dicyandiamide (DCDA) and 75.9 g of 95% strength paraformaldehyde (2.4 mol of monomeric formaldehyde) are stirred into 384 g (12 mol) of methanol. The mixture is heated up to 60° C. in a flask with a reflux condenser and kept at about 60° C. for 30 minutes. It is then cooled to 40° C., and 29.1 g (0.3 mol) of amidosulphonic form are added. During this addition, the temperature rises to 50° C. When the addition of acid has ended, the mixture is boiled under reflux for 10 minutes. It is cooled to 40° C. to give a clear solution. About 35 g of ammonium carbonate in solid form are added at 40° C. About 310 g of methanol are then distilled off under reduced pressure at a bath temperature of 40° C. After the residue has cooled, a solution of 29 g of diammonium hydrogen phosphate in 216 g of water is added and the mixture is heated at about 47° C. for about 5 minutes. A sample of the starting mixture before the start of the reaction was diluted with water (pH 7.14) in a volume ratio of 1:1 to determine the pH. The resulting sample had a pH of 8.9° at 20° C. After the methylolation, but still before the addition of amidosulphonic acid the reaction product had a pH of 8.35. The pH was 4.31 after addition of the amidosulphonic acid and 7.0 after addition of ammonium carbonate. A pH of 6.6 was measured after the addition of water and diammonium hydrogen phosphate and subsequent heating.

If appropriate, this procedure can be followed by addition of a boron compound of the type mentioned.

Component e):

Component e) is an at least partially etherified N,N'-dimethylol-dihydroxyethyleneurea. It is preferably etherified with an aliphatic alcohol having 1 to 4 C atoms. A mixture of compounds of varying degree of etherification is usually obtained on etherification of the substituted urea mentioned.

Suitable products which can be used as component e) and their preparation are described in DE-AS 22 49 272. Component e) serves as an agent for providing fibre materials which contain cellulose fibres or consist of cellulose fibres with a creaseproof finish.

The compositions according to the invention are particularly suitable for providing fibre materials, in particular textile sheet-like structures which contain cellulose fibres or consist of cellulose fibres, with a flame-resistant finish. It is advantageous here if the compositions have a pH of 2.0 to 4.5, in particular 2.0 to 3.5, at 20° C. It has been found that the amount of carboxylic acid with which a pH is kept in this range is adequately sufficient to effect fixing of the phosphono compound on the fibre material-after appropriate heat treatment (condensation)-so that the flame-resistant finish has a good permanence. Although even higher amounts of acids, or pH values of less than 2, are possible where appropriate, in the normal case they provide no advantages. They can even be a disadvantage in some cases. The compositions according to the invention advantageously consist to the extent of 40 to 70 % by weight of water and to the extent of 30 to 60% by weight of the sum of components a) to e) (the latter calculated as anhydrous substances).

The ratio of the amounts of components a) to e) relative to one another is preferably: (based on anhydrous substances)

300 to 500 parts by weight of a)
0 to 50 parts by weight of c)
0 to 10 parts by weight of d)
0 to 10 parts by weight of e)

and component b) in an amount such that the pH of this composition is between 2.0 and 4.5, preferably between 2.0 and 3.5, at 20° C.

The aqueous compositions according to the invention are outstandingly suitable for providing fibre materials, in particular materials which consist of cellulose fibres or contain cellulose fibres, with a flame-resistant finish. They impart to these materials permanent flameproofing, and above all if one or more of componentsother favourable propeother favourable properties, such as creaseproof pr ies. Possible fibre materials are, for example, textile sheet-like structures, such as woven fabric or knitted fabric. The compositions according to the invention can be applied to the fibre materials by generally customary methods, for example by means of a padding process. If appropriate, the compositions, which, as mentioned above, preferably contain 40 to 70% by weight of water, are brought to the desired use concentration for this purpose.

Depending on the nature of the composition according to the invention which is used (concentration, ratios of the amounts of the components relative to one another), it may be that this is not a homogeneously stable system over prolonged periods of time, but separates into two phases during storage. In this case it is of course advisable for the components (each individual one of which can be employed in the form of an aqueous solution or dispersion) to be mixed with one another only relatively shortly before use. If appropriate, the aqueous compositions according to the invention can also contain one or more dispersing agents, either to increase their stability or, for example, because commercially available products (in the form of dispersions) which already contain dispersing agents are used as components c) and e). After the treatment of the fibre material, in particular cellulose material, with a composition according to the invention, for example in a padding process, the goods are dried in the customary manner. In order to fix the phosphono compound, and if appropriate additionally the products which effect a creaseproof finish, to the fibre material, a heat treatment (condensation) is then carried out. The temperature during this treatment is preferably above 120° C., and in particular is in the range from 140 to 180° C. T time of the finished goods at this elevated temperature depends on the temperature chosen and is, for example, 1 to 10 minutes.

After the heat treatment (condensation), it is advantageous for the finished fibre material to be washed with an aqueous, alkaline solution, for example at 60°-80° C., to remove the free acid. A surfactant is also added to this solution if appropriate. Washing with an aqueous sodium carbonate solution has proved to be particularly appropriate, above all if oxalic acid has been used as the acid (component b)). Good results have been obtained, for example, with an aqueous solution containing 20 g/l of sodium carbonate, which also contains 2 g/l of a wetting agent, for example in the form of a nonionic ethoxylated product.

The invention will now be illustrated by working examples. The determination methods described below were used in these.

The effectiveness of the flame-resistant finish was determined via the burning properties of finished fabric samples. For this, the burning time and burned length were determined. The burning time was determined in accordance with DIN 54 336. The burning time is the time (in seconds) which elapses between the igniting flame being removed and the flames on the sample being extinguished. To determine the burned length, the fabric sample is ignited as for the determination of the burning time. After the igniting flame has been removed and the flame on the sample has been extinguished, the burned length is measured in min. It is the distance from the bottom edge of the sample (against which the igniting flame was held) to the upper end of the carbonisation zone.

The permanence of the flame-resistant finish, or the hydrolysis during storage in damp air and after washing operations, was determined via the change in the phosphorus and nitrogen content on the fibre and via the change in the "fabric pH value". The nitrogen was determined by the generally customary Kjeldahl method, and the phosphorus was determined colorimetrically as molybdate-vanadate after breakdown of the fabric sample by means of concentrated $H_2SO_4/HNO_3$. The "fabric pH value" is determined in accordance with the method of DIN 54 276, by shaking a fabric sample weighing 2 g with 100 ml of distilled water at room temperature for several hours and then measuring the pH of the aqueous solution. The phosphorus and nitrogen content of the fabric are quoted in % by weight, based on the weight of fabric.

In the results described below, higher values for the burning time and burned length mean that the time-resistant finish is less effective; a greater decrease in the P content, the N content and the fabric pH value mean increased hydrolysis of the finish, leading to products which can be washed out.

The fabric samples were obtained by the process in which undyed twill of 100 % cotton was treated with the corresponding formulations by means of a padding process, squeezed (liquor pick-up after squeezing off 80–84% by weight), dried (10 minutes/110° C.), condensed (for the purpose of fixing the finish on the fabric), subjected to an after-wash and dried again (10 minutes/110° C.). The condensation conditions were varied and are described below in the individual examples. Unless stated otherwise, the after-wash was carried out under the following conditions:

The fabric samples were washed for 20 minutes at 60° C. with an aqueous solution which contained 20 g/l of sodium carbonate (soda) and to which 2 g/l of a nonionic wetting agent (ethoxylate) had been added, and were then subjected to machine rinsing (clear rinsing with water) at 30° C. After the last drying process, the samples used for determination of the P and N content and also the burning time and burned length were washed at the boil. The samples for determination of the "fabric pH value" were not subjected to washing at the boil. After being washed at the boil, the samples were dried at 110° C. for 10 minutes. Before the individual determinations were carded out, the samples were conditioned at 60° C. and 100% relative humidity. The burned length was in each case determined only once after conditioning, and the other data were determined several times after various storage times. The following components were used in the examples below:

Component A): 90% by weight of phosphono compound of the formula (II) (see Claim 4) where $R^4 = R^5 = CH_3$, 10% by weight of water Component B): 58% by weight of pentamethylolmelamine, partially etherified with methanol, 33% by weight of water, about 2% of each of the following substances: ethylene glycol, Na toluenesulphonate, methanol and formaldehyde.

Component C): 50% by weight of a reaction product of dicyandiamide and formaldehyde, partially etherified with methanol, 50% by weight of water (cf. component d in claim 6).

In each case the amounts of these components stated in the examples were mixed together with further additives (oxalic acid or phosphoric acid). The mixture was then made up to a total volume of 1l with water. The fabrics were padded with the formulations thus obtained.

EXAMPLES 1a) to 1d) (oxalic acid-phosphoric acid comparison)

| | |
|---|---|
| Formulations: | |
| 1a) (according to the invention): | 385 g/l of A<br>80 g/l of B<br>14 g/l of oxalic acid<br>pH: 2.4 |
| 1b): as 1a) | |
| 1c) (according to the invention): | 385 g/l of A<br>80 g/l of B<br>7 g/l of oxalic acid<br>pH: 3.1 |
| 1d) (comparison): | 385 g/l of A<br>80 g/l of B<br>25 g/l of phosphoric acid<br>pH: 2.4 |
| Condensation conditions: | |
| 1a, 1c and 1d: | 150° C./5 minutes |
| 1b: | 170° C./5 minutes |

EXAMPLES 2a) to 2d)

The influence of the amount of oxalic acid was investigated in these examples.

| | |
|---|---|
| Formulations: | |
| In each case | 385 g/l of A<br>80 g/l of B |
| additionally: | |
| 2a) (comparison not according to the invention): | 25 g/l of phosphoric acid<br>pH of the formulation: 2.5 |
| 2b) | 14 g/l of oxalic acid, pH 2.5 |
| 2c) | 10 g/l of oxalic acid, pH 2 8 |
| 2d) | 5 g/l of oxalic acid, pH 3.4 |
| Condensation conditions: | 150° C./5 minutes. |

In further experiments, the results of which are not reproduced in detail here, it was found that the process can also be carried out with even smaller amounts of oxalic acid, for example with 2 or 3 g/l (pH of the solution up to 4 or more).

EXAMPLES 3a to d

The addition of component C) was investigated in these examples.

| | |
|---|---|
| Formulations: | |
| In each case | 385 g/l of A<br>80 g/l of B<br>14 g/l of oxalic acid |
| additionally | |
| 3a: | 5 g/l of C, pH of the formulation: 2.2 |
| 3b: | 10 g/l of C, pH of the formulation: 2.2 |
| 3c: | 20 g/l of C, pH of the formulation: 2.2 |
| 3d: | 30 g/l of C, pH of the formulation: 2.2 |
| Condensation conditions: | 150° C./5 minutes |

The results are reproduced in the following Tables I to III. In these tables, an * in t""burning time" column means that the f was not extinguished by itself, that is to say the fabric burned throughly.

TABLE I (Examples 1a to d)

| | Example | | | |
|---|---|---|---|---|
| | 1a according to the invention | 1b according to the invention | 1c according to the invention | 1d (comparison) |
| Burned length (mm) | 30 | 30 | 30 | 35 |
| Burning time (in s) after storage for (in days) | | | | |
| 0 days | 0 | 0 | 0 | 0 |
| 2 days | 0 | 0 | 0 | 0 |
| 4 days | 0 | 0 | 0 | 0 |
| 7 days | 2 | 1 | 1 | * |
| 12 days | * | * | * | * |
| P content (% by weight) after storage | | | | |
| 0 days | 2.2 | 2.3 | 1.9 | 2.0 |
| 2 days | 2.1 | 2.2 | 1.9 | 1.9 |
| 4 days | 1.8 | 2.1 | 1.8 | 1.8 |
| 7 days | 1.6 | 2.0 | 1.5 | 1.5 |
| 12 days | 0.9 | 1.3 | 0.8 | 0.9 |
| N content (% by weight) | | | | |
| 0 days | 1.8 | 1.8 | 1.8 | 1.6 |
| 2 days | 1.8 | 1.8 | 1.8 | 1.5 |
| 4 days | 1.6 | 1.7 | 1.7 | 1.3 |
| 7 days | 1.3 | 1.4 | 1.4 | 0.9 |
| 12 days | 0.7 | 0.9 | 0.9 | 0.6 |
| Fabric pH | | | | |
| 0 days | 9.5 | 9.5 | 9.5 | 9.7 |
| 2 days | 8.0 | 8.0 | 7.9 | 8.0 |
| 4 days | 7.3 | 7.3 | 7.3 | 7.3 |
| 7 days | 6.0 | 6.2 | 6.2 | 6.5 |
| 12 days | 4.8 | 4.6 | 4.6 | 4.6 |

TABLE II (Examples 2a to d)

| | Example | | | |
|---|---|---|---|---|
| | 2a (Comparison) | 2b according to the invention | 2c according to the invention | 2d according to the invention |
| Burned length (mm) | 28 | 20 | 28 | 35 |
| Burning time (in s) after storage for (in days) | | | | |
| 0 days | 0 | 0 | 0 | 0 |
| 2 days | 0 | 0 | 0 | 0 |
| 4 days | 0 | 1 | 0 | 0 |
| 7 days | 1 | 1 | 0 | 0 |
| 12 days | * | 2 | 4 | 5 |
| 17 days | * | * | * | * |
| P content (% by weight) after storage | | | | |
| 0 days | 2.2 | 2.4 | 2.1 | 1.6 |
| 2 days | 2.0 | 2.2 | 2.2 | 1.6 |
| 4 days | 1.8 | 2.2 | 2.1 | 1.6 |
| 7 days | 1.7 | 2.0 | 1.9 | 1.6 |
| 12 days | 1.1 | 1.7 | 1.6 | 1.4 |
| 17 days | 0.7 | 1.3 | 1.3 | 1.3 |
| N content (% by weight) | | | | |
| 0 days | 1.7 | 1.8 | 1.8 | 1.7 |
| 2 days | 1.6 | 1.8 | 1.8 | 1.7 |
| 4 days | 1.4 | 1.7 | 1.7 | 1.6 |
| 7 days | 1.1 | 1.6 | 1.5 | 1.5 |
| 12 days | 0.7 | 1.0 | 1.1 | 1.3 |
| 17 days | 0.6 | 0.9 | 0.9 | 1.2 |
| Fabric pH | | | | |
| 0 days | 8.5 | 9.7 | 9.7 | 9.7 |
| 2 days | 7.4 | 9.0 | 9.1 | 9.3 |
| 4 days | 6.9 | 8.2 | 8.9 | 9.0 |
| 7 days | 6.5 | 7.5 | 7.5 | 8.2 |
| 12 days | 5.1 | 6.1 | 6.1 | 7.0 |

TABLE II-continued

| | (Examples 2a to d) Example | | | |
|---|---|---|---|---|
| | 2a (Comparison) | 2b according to the invention | 2c according to the invention | 2d according to the invention |
| 17 days | 4.4 | 5.0 | 5.0 | 6.8 |

TABLE III

| | (Examples 3a to d) Example | | | |
|---|---|---|---|---|
| | 3a | 3b | 3c | 3d |
| Burned length (mm) | 20 | 18 | 18 | 18 |
| Burning time (in s) after storage for (in days) | | | | |
| 0 days | 0 | 0 | 0 | 1 |
| 2 days | 1 | 1 | 1 | 1 |
| 4 days | 0 | 0 | 0 | 0 |
| 7 days | 0 | 0 | 0 | 0 |
| 12 days | 1 | 5 | 5 | 4 |
| 17 days | * | * | 7 | * |
| P content (% by weight) after storage | | | | |
| 0 days | 2.1 | 2.0 | 1.9 | 1.8 |
| 2 days | 2.1 | 2.0 | 1.8 | 1.8 |
| 4 days | 2.1 | 1.9 | 1.8 | 1.7 |
| 7 days | 2.0 | 1.8 | 1.7 | 1.6 |
| 12 days | 1.7 | 1.5 | 1.3 | 1.4 |
| 17 days | 1.2 | 1.3 | 1.2 | 1.1 |
| N content (% by weight) | | | | |
| 0 days | 1.9 | 1.9 | 1.9 | 1.9 |
| 2 days | 1.8 | 1.8 | 1.8 | 1.9 |
| 4 days | 1.8 | 1.8 | 1.8 | 1.8 |
| 7 days | 1.6 | 1.6 | 1.7 | 1.6 |
| 12 days | 1.2 | 1.2 | 1.3 | 1.4 |
| 17 days | 0.9 | 0.9 | 1.0 | 1.0 |
| Fabric pH | | | | |
| 0 days | 8.8 | 8.8 | 8.8 | 8.8 |
| 2 days | 9.0 | 9.0 | 9.0 | 9.0 |
| 4 days | 9.1 | 9.0 | 9.0 | 8.7 |
| 7 days | 8.1 | 8.0 | 8.0 | 7.9 |
| 12 days | 6.8 | 7.2 | 7.4 | 7.2 |
| 17 days | 5.3 | 5.6 | 6.3 | 5.6 |

I claim:

1. An aqueous flame-proofing composition containing the following components:

a) an effective flameproofing amount of a phosphono compound of the formula

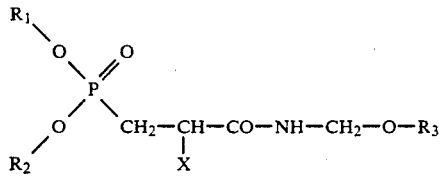

(I)

wherein $R_1$ and $R_2$ are independently selected from the group consisting of alkyl radicals having 1 to 4 carbon atoms and phenyl radicals which are unsubstituted or substituted by one or more halogen atoms, or wherein $R_1$ and $R_2$ together is selected from the group consisting of alkylene bridges having a maximum of 4 carbon atoms which are unsubstituted or substituted by one or more halogen atoms, X is H or $CH_3$ and $R_3$ is selected from the group consisting of hydrogen, allyl radicals and alkyl radicals having 1 to 6 carbon atoms, and b) an acid, selected from the group consisting of dibasic and tribasic aliphatic carboxylic acids having 2 to 6 carbon atoms and mixtures thereof, in an amount such that the pH of said composition is between 2.0 and 4.5 at 20° C.

2. Composition according to claim 1, wherein the acid is oxalic acid.

3. Composition according to claim 1, wherein it additionally contains as component c) a water-soluble substituted melamine, some or all of the amino groups of which are methylolated, it being possible for some or all of these N-methylol groups to be etherified with an aliphatic alcohol.

4. Composition according to claim 1, wherein it additionally contains as component d) a product which is formed by reaction of dicyandiamide with formaldehyde and D subsequent at least partial etherification of the N-methylol groups formed.

5. Composition according to claim 1, wherein it additionally contains as component e) an at least partially etherified N,N'-dimethylol-dihydroxyethylene-urea.

6. Composition according to claim 1, wherein it has a pH in the range from 2.0 to 3.5 at 20° C.

7. Composition according to claim 1, in which the phosphono compound a) is a compound of the formula

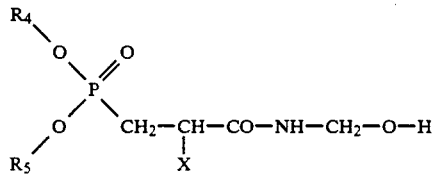

(II)

wherein $R_4$ and $R_5$ are independently selected from the group consisting of a methyl and ethyl groups.

8. Composition according to claim 1, said composition containing 40 to 70% by weight of water and the following components in the following ratios of amounts relative to one another:

300 to 500 parts be weight of a) 0 to 50 parts by weight of a water-soluble substituted melamine, some or all of the amino groups of which are methylolated, wherein some or all of said N-methylol groups are etherified with an aliphatic alcohol, 0 to 10 parts by weight of a product which is formed by reaction of dicyandiamide with formaldehyde and subsequent at least partial etherification of the N-methylol groups formed, 0 to 10 parts by weight of an at least partially etherified, N,N'-dimethylol-dihydroxyethyleneurea, and component b) in an amount such that pH of said composition is between 2.0 and 4.5 at 20° C.

* * * * *